US006769717B2

(12) United States Patent
Pacifici

(10) Patent No.: US 6,769,717 B2
(45) Date of Patent: Aug. 3, 2004

(54) METHOD AND COMPOSITIONS FOR BINDING LOOSE SHEETS

(75) Inventor: David Pacifici, Rome (IT)

(73) Assignee: Economic Strategies, Inc., Tortola (VG)

( * ) Notice: Subject to any disclaimer, the term of this patent is extended or adjusted under 35 U.S.C. 154(b) by 0 days.

(21) Appl. No.: 09/862,976

(22) Filed: May 22, 2001

(65) Prior Publication Data

US 2001/0030419 A1 Oct. 18, 2001

Related U.S. Application Data

(63) Continuation of application No. 09/201,977, filed on Dec. 1, 1998, now abandoned.

(30) Foreign Application Priority Data

Dec. 1, 1997 (IT) ..... RM970262 U
Dec. 1, 1997 (IT) ..... RM970263 U

(51) Int. Cl.[7] ..... B42D 1/00

(52) U.S. Cl. ..... 281/21.1; 281/2; 283/61; 412/33; 412/36; 428/40.1; 428/42.2

(58) Field of Search ..... 412/33, 36, 34, 412/37, 900, 904; 428/40.1, 42.2, 41.8, 41.7; 281/21.1, 23, 2, 5; 283/61, 62

(56) References Cited

U.S. PATENT DOCUMENTS

| | | | | | |
|---|---|---|---|---|---|
| 3,856,332 | A | * | 12/1974 | Snedeker | 281/38 |
| 3,900,642 | A | | 8/1975 | Michel | |
| 4,386,135 | A | * | 5/1983 | Campbell et al. | 428/447 |
| 4,422,672 | A | * | 12/1983 | Levi | 283/39 |
| 4,447,481 | A | * | 5/1984 | Holmberg et al. | 428/41.7 |
| 4,525,116 | A | | 6/1985 | Holmberg | |
| 4,673,324 | A | * | 6/1987 | Hanson et al. | 412/6 |
| 4,789,187 | A | * | 12/1988 | Corlew et al. | 281/15 R |
| 4,818,576 | A | | 4/1989 | Pennace et al. | |
| 4,861,212 | A | | 8/1989 | Cordia | |
| 4,884,826 | A | | 12/1989 | Slagsvol | |
| 5,127,677 | A | | 7/1992 | Merry | |
| 5,130,185 | A | * | 7/1992 | Ness | 428/40 |
| 5,169,254 | A | * | 12/1992 | Arkwright | 281/21.1 |
| 5,230,501 | A | * | 7/1993 | Melton | 270/37 |
| 5,273,805 | A | | 12/1993 | Calhoun et al. | |
| 5,372,865 | A | | 12/1994 | Arakawa et al. | |
| 5,376,420 | A | | 12/1994 | Yamamoto et al. | |
| 5,453,141 | A | | 9/1995 | Rodriguez | |
| 5,524,998 | A | * | 6/1996 | Schwartz | 281/21.1 |
| 5,658,629 | A | * | 8/1997 | Delcuve et al. | 428/41.3 |
| 5,672,404 | A | | 9/1997 | Callahan, Jr. et al. | |
| 5,786,062 | A | | 7/1998 | Callahan, Jr. et al. | |
| 6,306,475 | B1 | * | 10/2001 | Stocq et al. | 428/40.1 |

FOREIGN PATENT DOCUMENTS

| | | | |
|---|---|---|---|
| EP | 0160519 | | 11/1985 |
| EP | 0387932 | | 9/1990 |
| EP | 919400 | * | 6/1999 |
| GB | 2016372 | | 9/1979 |
| JP | 11-235886 | * | 12/1997 |

OTHER PUBLICATIONS

Pacifici, U.S. patent application No. 09/201,977, filed Dec. 1, 1998.

* cited by examiner

*Primary Examiner*—Monica S. Carter
(74) *Attorney, Agent, or Firm*—Baker Botts LLP

(57) ABSTRACT

The invention relates to a sheet (1; 11; 21; 31) prepared beforehand for the binding, characterised in that it provides a glue or both sides adhesive tape strip (2; 12; 22; 32) along at least one of its edges, or close to the same edge, and a silicone material band (3; 13; 23; 33), realasably placed on said glue or both sides adhesive tape strip (2; 12; 22; 32) and having at least a portion (4; 14; 24; 34) not coupled to said glue or both sides adhesive tape strip (2; 12; 22; 32) to grasp the silicone band (3; 13; 23; 33), during its removal and the binding.

The invention further relates to an adhesive band for binding loose sheets.

4 Claims, 10 Drawing Sheets

METHOD AND COMPOSITIONS FOR BINDING LOOSE SHEETS

This application is a continuation of U.S. patent application No. 09/201,977, filed Dec. 1, 1998, now abandoned, which claims priority to Italian Patent Applications Nos. RM97-U/000262 and RM97-U/000263, both filed Dec. 1, 1997. This application incorporates herein the entirety of U.S. patent application Ser. No. 09/201,977 by reference.

The present invention relates to a sheet prepared for the binding.

More specifically, the invention relates to a sheet providing a lateral or upper strip, that allows to bind the same coupling with other sheets and/or a binding cover.

The invention further relates to an adhesive band for binding loose sheets.

As it is well known, in the office working it often occurs to have to or to wish to bind different sheets, printed by the computer, written by typewriter or containing drawings and graphical representations, in order to confer to the work a more proper format.

Obviously, except for particular cases, it is not always possible to refer to an bookbinder outside the office, involving remarkable costs and not negligible time to end the work.

Therefore, in many offices binding machines are provided, said machines being specifically studied and realised to this aim.

Sheets are placed within a cover, prepared along its back portion with a heat activated glue or both sides adhesive tape strip.

Sheets and cover are than placed into a binding machine, provided with a heating system, by electrical resistance or other system, dissolving the glue or both sides adhesive tape provided in the cover within which the sheets are provided.

At the end of this operation, it is necessary to wait for the solidification of the glue or both sides adhesive tape, until when the binding has been finished.

It is well evident that said solution, even if more advantageous than the one providing the sending of the text to be bound at the bookbinder, has many drawbacks.

First of all, reference must be made to the initial expenses to buy the binding machine, expense that even if not so high, cannot be completely negligible.

However, most relevant problem is undoubtedly that of time necessary to make and complete the binding.

Furthermore, it must be taken into consideration that it is impossible to make many bindings at the same time, so that in some cases time is even longer.

Also other systems exists requiring the drilling of the sheets, the use of plastic rings or spiral and suitable machines for drilling and applying the same. They are systems having all the above problems.

In this situation, it can be introduced the solution according to the present invention allowing to obtain perfectly bound documents.

Main object of the present invention is that of providing a solution allowing the bonding of loose sheets in a very quick and reliable way.

Another object of the present invention is that of providing a solution for binding loose sheet extremely cheap.

These and other objects are obtained according to the present invention suggesting a sheet having along one edge and adhesive strip, protected by a silicone band, realised in such a way to be grasped for its removal during the binding.

Furthermore, the solution according to the present invention proposes a band prepared with a glue layer in order to make it adhering to a paper sheet to be bound with other sheets by the same glue.

It is therefore specific object of the present invention a sheet prepared beforehand for the binding, characterised in that it provides a glue or both sides adhesive tape strip along at least one of its edges, or close to the same edge, and a silicone material band, releasably placed on said glue or both sides adhesive tape strip and having at least a portion not coupled to said glue or both sides adhesive tape strip to grasp the silicone band during its removal and the binding.

Furthermore, according to the invention, said sheet can provide said glue or both sides adhesive tape strip, and the relevant silicone band on both sides, on opposite surfaces.

The glue or both sides adhesive tape strip on the sheets according to the invention can be provided on a lateral edge or on an upper or lower edge.

Still according to the invention, said sheets are realised as a continuous snap out, provided with lateral dragging bands, said grasping portion of the silicone band being coupled by weakening lines with the band of the following sheet.

Always according to the invention, said silicone band is larger than said glue or both sides adhesive tape strip, and can be folded outwardly during the bonding, said portion of the silicone band larger than the glue or both sides adhesive tape strip being the grasping portion.

In a preferred embodiment of the sheet according to the invention, to make its binding, it is superimposed to other sheets to be bound, being them prepared or not according to the invention, and thus the different projecting grasping portion are grasped and drawn at the same time to uncover the various glue or both sides adhesive tape strips.

The present invention further provides a device for packaging and binding sheets, providing at least two 90° projecting sides upon which resting the sheets to be bound.

Preferably, said device provides a silicone zone in correspondence of the glue or both sides adhesive tape strip of the sheets to avoid that a sheet attaches to the same device during the binding.

It is furthermore within the scope of the present invention an adhesive band to bind loose sheets comprising a silicone material support, having a substantially elongated shape, slightly attachable by the glue, alternatively providing on one side portions provided with cold activated glue and shorter portions without glue.

Preferably, according to the invention, said band is continuous, at the end of each section the support providing a cut facilitation or breaking lines and/or an optical or mechanical signal to indicate the cutting point to suitable apparatuses to automatically apply it on sheets.

The function of portions without glue is that of being out of the sheet to provide the opportunity of an easy removal of the silicone support which after the application of the glue on the sheet has the function of protecting from eventual gluing not wished before the binding.

Preferably, according to the invention, said band is wound, the outer surface of the support band being preferably refactory to the glue.

Alternatively, according to the invention, said support can provide, instead of the glue portions, both sides adhesive portions, i.e. a second support comprised of any suitable material providing glue on both sides, one of which is destined to adhere to the sheet to be bound, the second one being destined to adhere to the sheet that during the binding will be coupled to the sheet providing the band.

Always according to the invention, said band can be applied on both sides of a sheet.

Furthermore according to the invention, said band can be applied manually, or by a suitable device, provided along the path within the printer.

The present invention will be now described, for illustrative but not limitative purposes, according to its preferred embodiments, with particular reference to the figures of the enclosed drawings, wherein.

Figure 1:
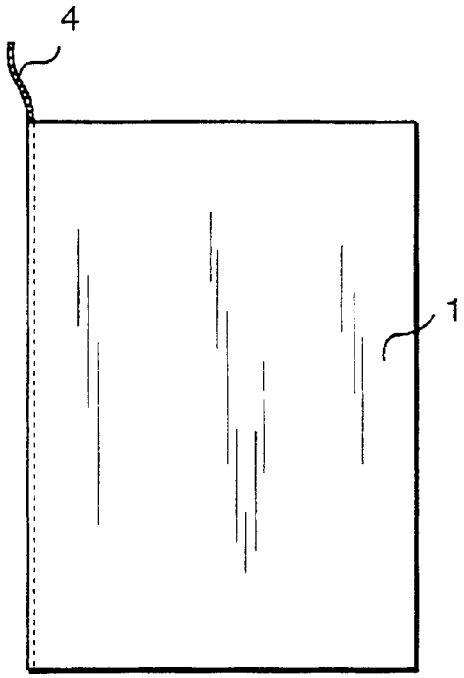
FIG. 1 is a first front view of a sheet according to the invention.
Figure 2:
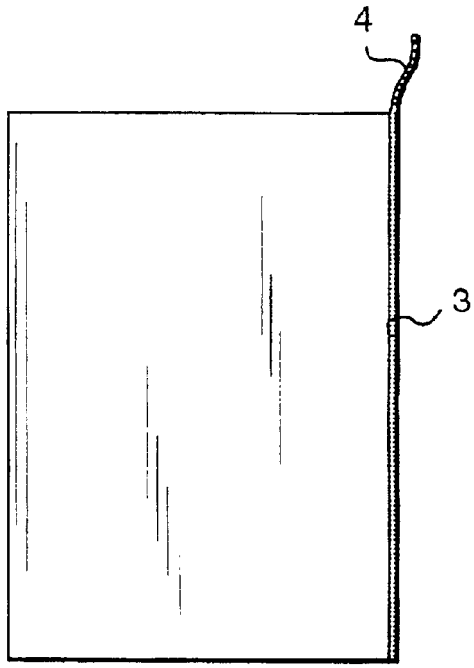
FIG. 2 is a second front view of the sheet of FIG. 1.
Figure 3:
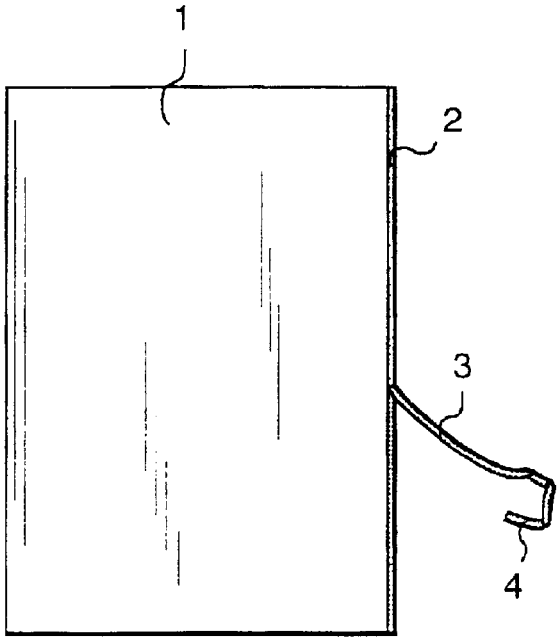
FIG. 3 shows the sheet of FIG. 2 with the protection partially removed.

Observing first FIGS. 1–3, it is shown a first kind of sheet 1 according to the invention, providing a glue or both sides adhesive tape strip 2 along an edge, covered by a silicone band 3 having a portion projecting beyond the sheet (see FIGS. 1 and 2).

FIG. 3 shows how it is possible to remove the silicone band 3 to expose the glue or both sides adhesive tape strip 2.

Figure 4:
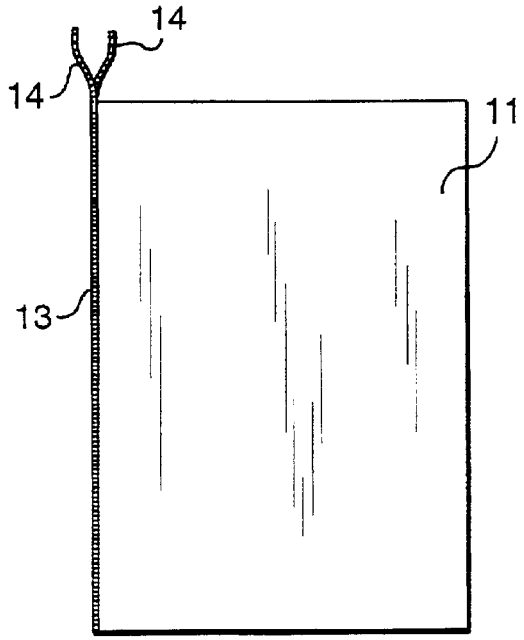
FIG. 4 is a first front view of a second sheet according to the invention.
Figure 5:
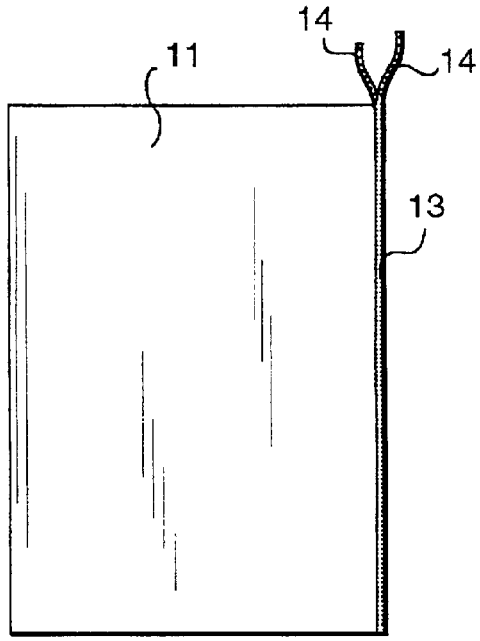
FIG. 5 is a second front view of the sheet of FIG. 4.
Figure 6:
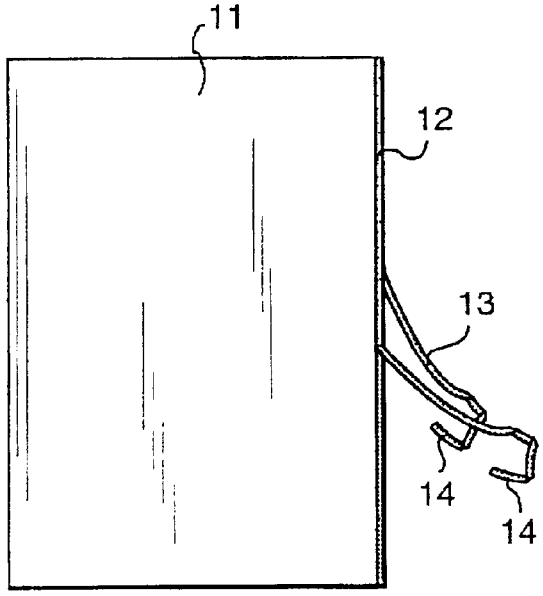
FIG. 6 shows the sheet of FIG. 4 with the protection partially removed.
Figure 7:
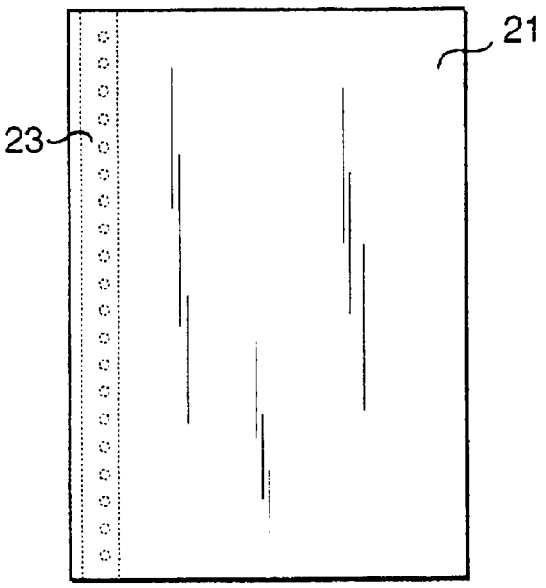
FIG. 7 is a first front view of a third sheet according to the invention.
Figure 8:
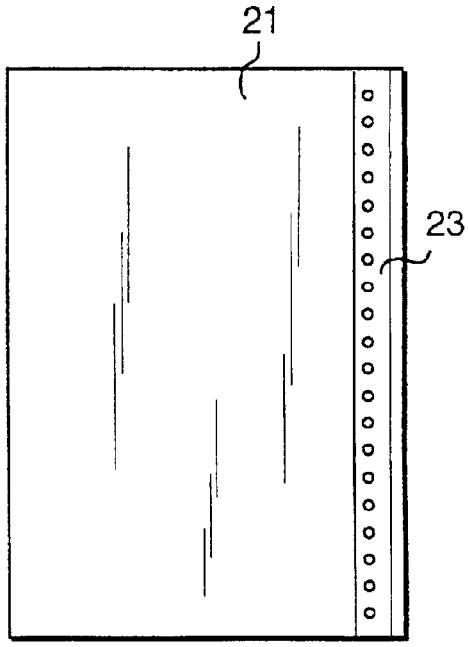
FIG. 8 is a second front view of the sheet of FIG. 7.
Figure 9:
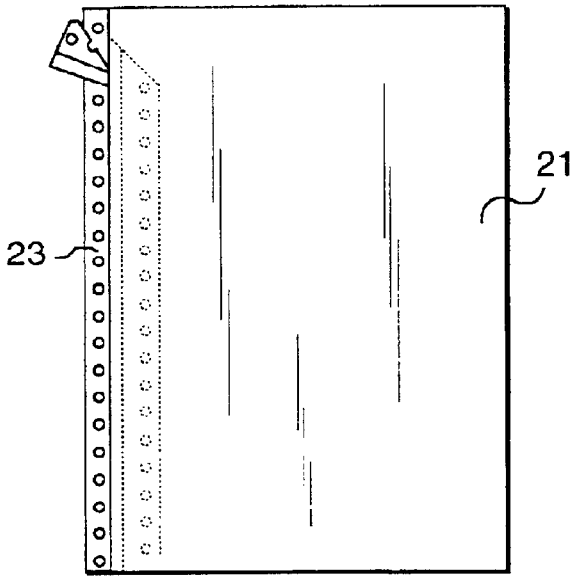
FIG. 9 shows the sheet of FIG. 7 with the grasping portion laterally provided.
Figure 10:
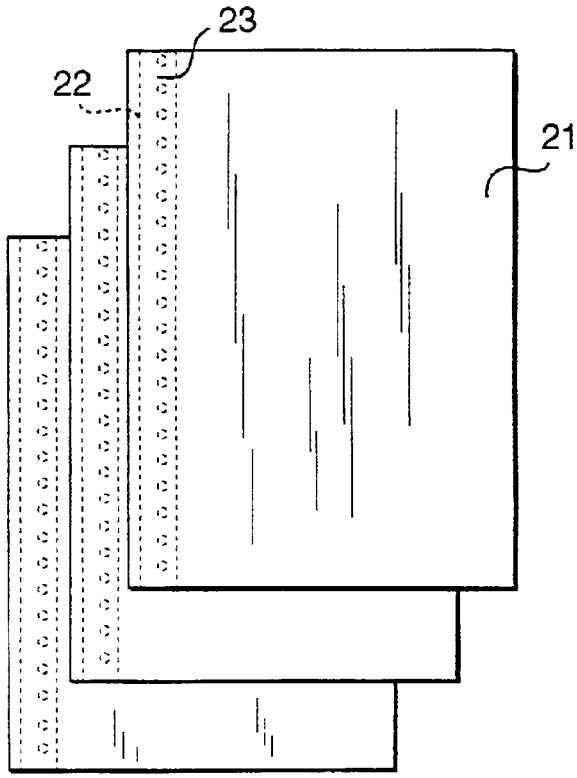
FIG. 10 shows a group of sheets according to FIG. 7 ready for binding.

The sheet 11 of FIGS. 4, 5 and 6 provides the same kind of features of sheet 1 of the preceding figures, but in this case the glue or both sides adhesive tape strip 12 is provided on both sides of the sheet 11, with two silicone bands 13, one for each glue or both sides adhesive tape strip and the relevant grasping portions 14 projecting from the sheet 11.

The double glue or both sides adhesive tape strip 12 is provided in order to be able to bind together with the sheet 11 also sheets not prepared according to the present invention.

Figure 19:
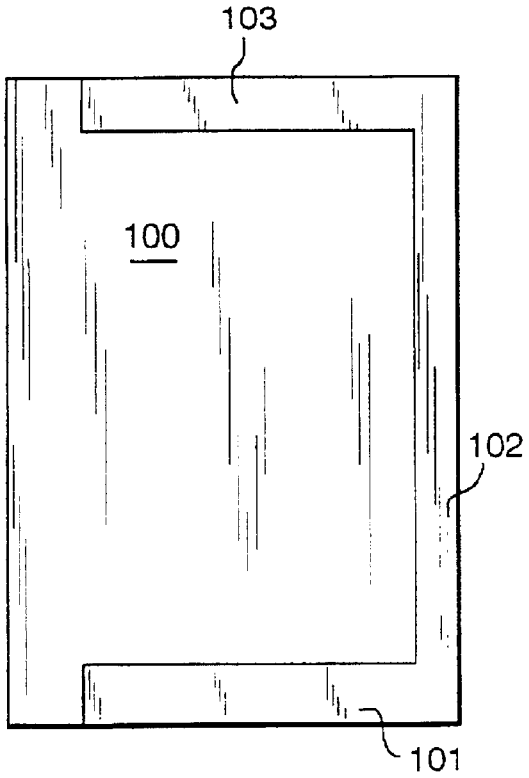
FIG. 19 shows a device for a proper positioning of the sheets according to the invention.
Figure 20:
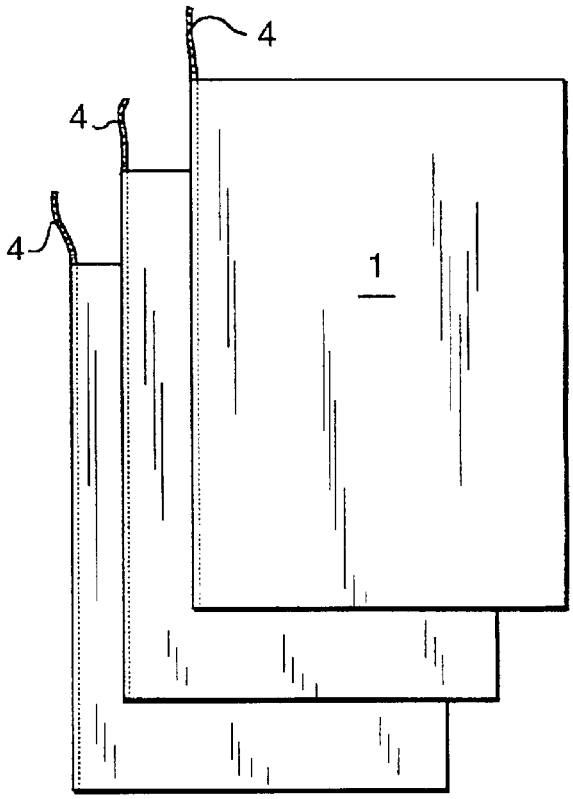
FIG. 20 shows a group of sheets according to FIG. 1 ready for binding.

In FIG. 19, a device 100 is shown useful to align the different sheets 1 or 11 during the binding, but that can also be used to package and selling sheets according to the invention.

Figure 21:
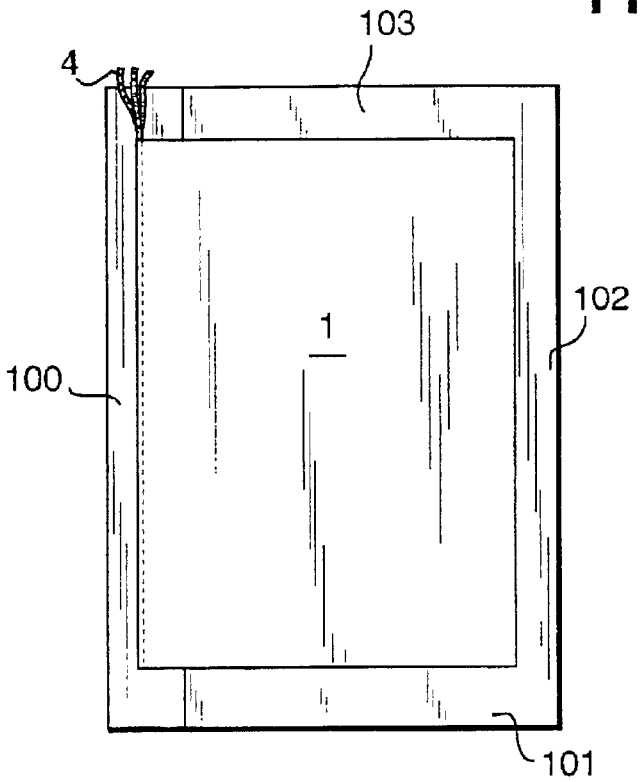
FIG. 21 shows the sheets of FIG. 20 on the device of FIG. 19

Said device 100 provides sides 101, 102, 103 placed at 90° each other for the proper positioning of the various sheets to be bound, as shown in FIG. 21. Furthermore, device 100 provides a silicone portion 104 avoiding the adhesion of a sheet 1 or 11 if erroneously positioned on the device with the glue or both sides adhesive tape strip uncovered.

When all sheets 1 have been placed side by side, with the grasping portions 4 of the strip 3 provided on the same side, it will be sufficient to keep the sheets still and pulling the strips 3 grasping the portions 4, in order to remove the strips 3 all together, freeing the glue or both sides adhesive tape strip 2 on all sheets and thus obtaining the binding quickly and immediately.

Also a cover (not shown) can be obviously provided on the sheets bound with the sheets 1 or 11 since it is prepared beforehand according to the invention, or by employing a sheet 1.

Coming now to observe FIGS. from 7 to 11, it is shown a further embodiment of the sheet according to the invention.

As in the preceding cases, the sheet 21 provides a glue or both sides adhesive tape strip 22, on which a releasable silicone band 23 is provided.

In this case, the silicone band 23 does not project from the sheet 21, but is wider than the glue or both sides adhesive tape strip 22 and the grasping portion 24 is comprised of the part of the band 23 wider than the strip 22.

Figure 11:
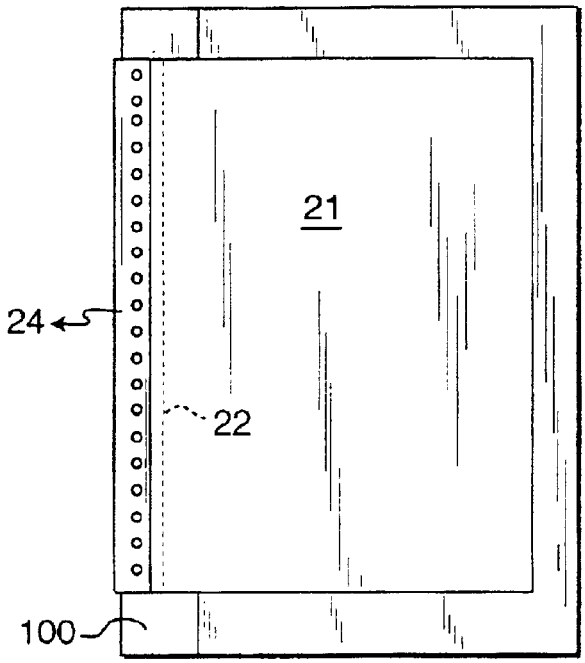
FIG. 11 shows the sheets of FIG. 7 on the device of FIG. 19.

When the sheet must be printed, for example in a ink jet or laser printer, portion 24 is folded inward, while it is folded outward when it is bound on the device 100, as shown in FIG. 11.

Therefore, after having separated the single sheets, a section of silicone band 23 projects from each sheet 21, acting as grasping element to eliminate the protection of the glue during the binding of the superimposed sheets.

Figure 12:
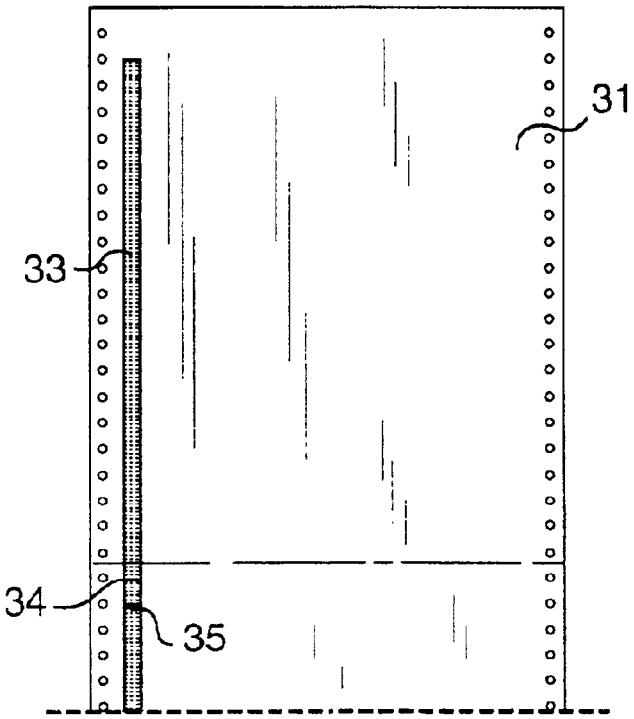
FIG. 12 is a front view of a fourth sheet according to the invention.
Figure 13:
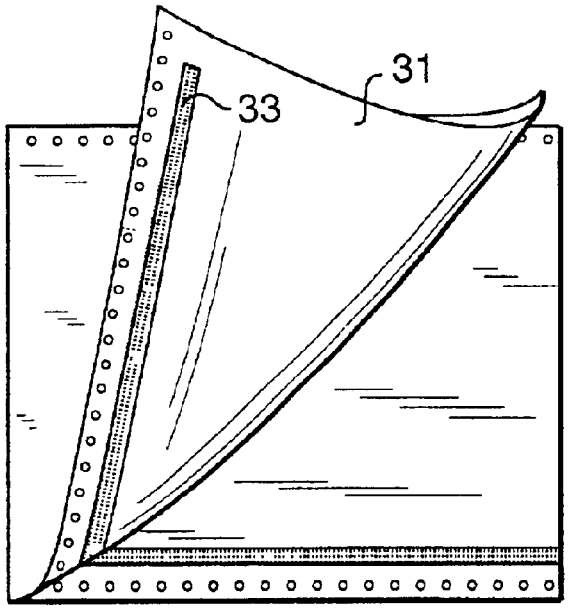
FIG. 13 shows the sheet of FIG. 12 with the protection partially removed.

In FIGS. 12 and 13 a further embodiment of the sheet according to the invention is shown. They are sheets for continuous feeding, e.g. in computer printers.

In this case, sheet 31, providing a glue or both sides adhesive tape strip 32 along the edge, has a silicone band 33, the grasping portion 34 of which does not project from the upper edge of sheet 31, since it is coupled to another sheet 31 of the continuous module, but is on the following sheet (see FIG. 12), and is coupled with the silicone band 33 of the following sheet by a weakened line 35.

Therefore, folding the grasping portion 34 outwardly after having detached the sheets, it will be possible to act on all the grasping portions 34 of the various sheets of the continuous module and making the relevant binding, eventually employing the device 110 of FIG. 19.

In FIGS. 14, 15 and 16 and 17 and 18, it can be seen the sheet 41 for continuous feeding, wherein the glue or both sides adhesive tape strip 42, along with the silicone band 43, is provided on the upper side of the alternated sheets, instead of on the lateral edge.

Figure 14:
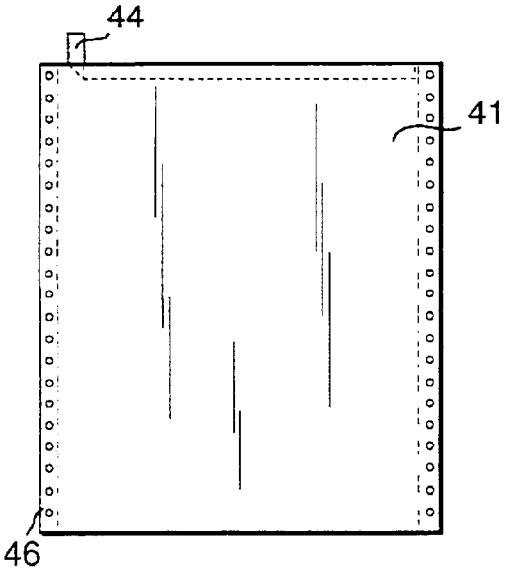
FIG. 14 is a front view of a further sheet according to the invention, for the continuous feeding.
Figure 15:
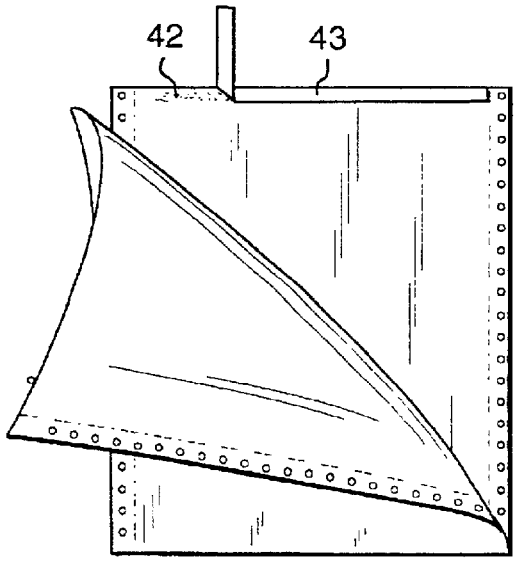
FIG. 15 is a front view of the sheet of FIG. 14 with the protection partially removed.
Figure 16:
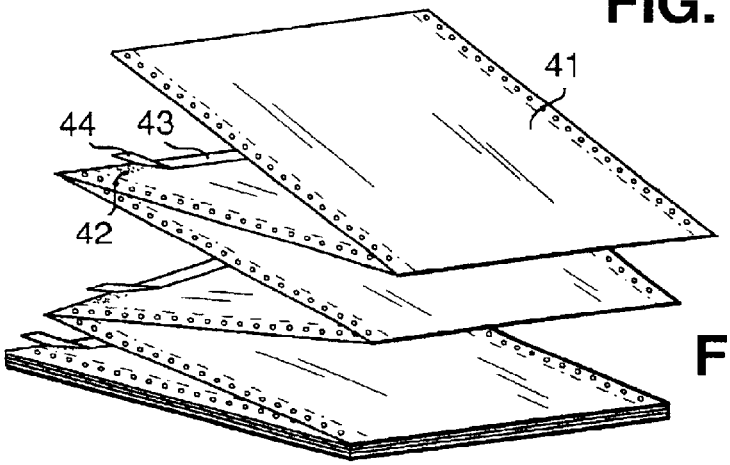
FIG. 16 is a perspective view of the sheet of FIG. 14.

Solution shown in FIGS. 14, 15 and 16 provides the grasping portion folded upwardly, in such a way to be able to grasp all the grasping portions together, as in the preceding cases.

Figure 17:
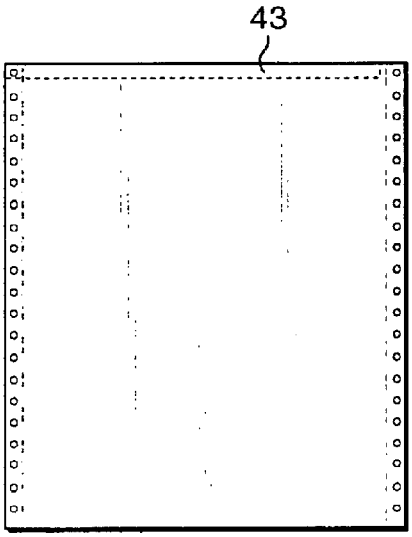
FIG. 17 is a front view of a fifth sheet according to the invention, also for the continuous feeding.
Figure 18:
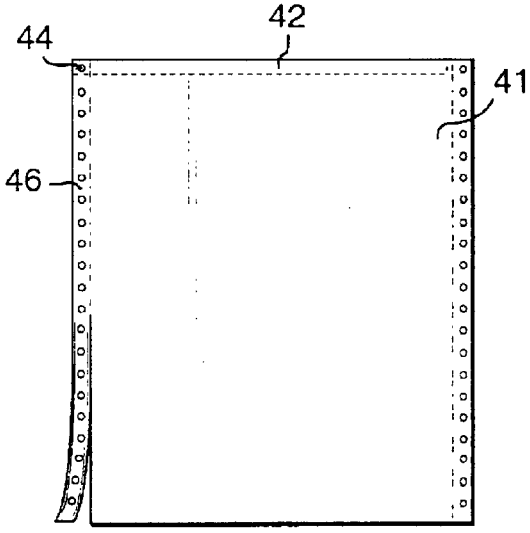
FIG. 18 shows the sheet of FIG. 17 with the protection partially removed.

Instead, sheet 41 of FIGS. 17 and 18 provides the grasping portion 44 firmly and permanently coupled to the holed band of the continuous feeding module. When the holed band 46 is torn away (see FIG. 18), also the grasping portion 44 is dragged, thus removing the silicone band 43 and realising the binding.

According to the invention, the side of the continuous module providing the glue or both sides adhesive tape strip 42 is preferably folded only with respect to the adjacent sheet, while on the opposite side a tearing line is as usual provided (see FIG. 16).

Sheets according to the present invention can be freely used also on matrix printers, copying machines and in any other printing machine.

The solution proposed according to the present invention allows to bind in an easy, resistant and efficient way files having any thickness. The binding step is extremely fast, well finished and immediate, without dirtying and without the need of employing expensive and bulky machines.

Coming now to observe FIGS. from 22 to 28, the adhesive band for binding according the invention can be provided to the consumers in any shape, for example as a roll.

Furthermore, it can be applied on single sheets manually or by a suitable device, which is not part of the present invention, for example directly provided along the paper path of the printer connected with the computer by which the sheet has been filled in.

Figure 22:
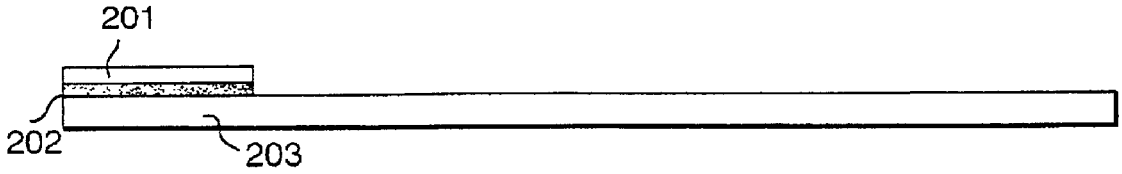
FIG. 22 is a section view of a first embodiment of a band according to the invention.
Figure 24:
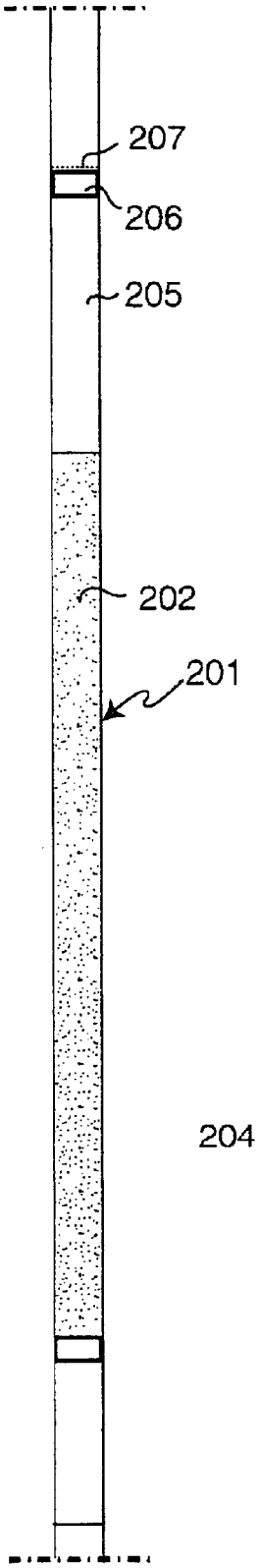
FIG. 24 shows a portion of a band according to the invention.
Figure 25:
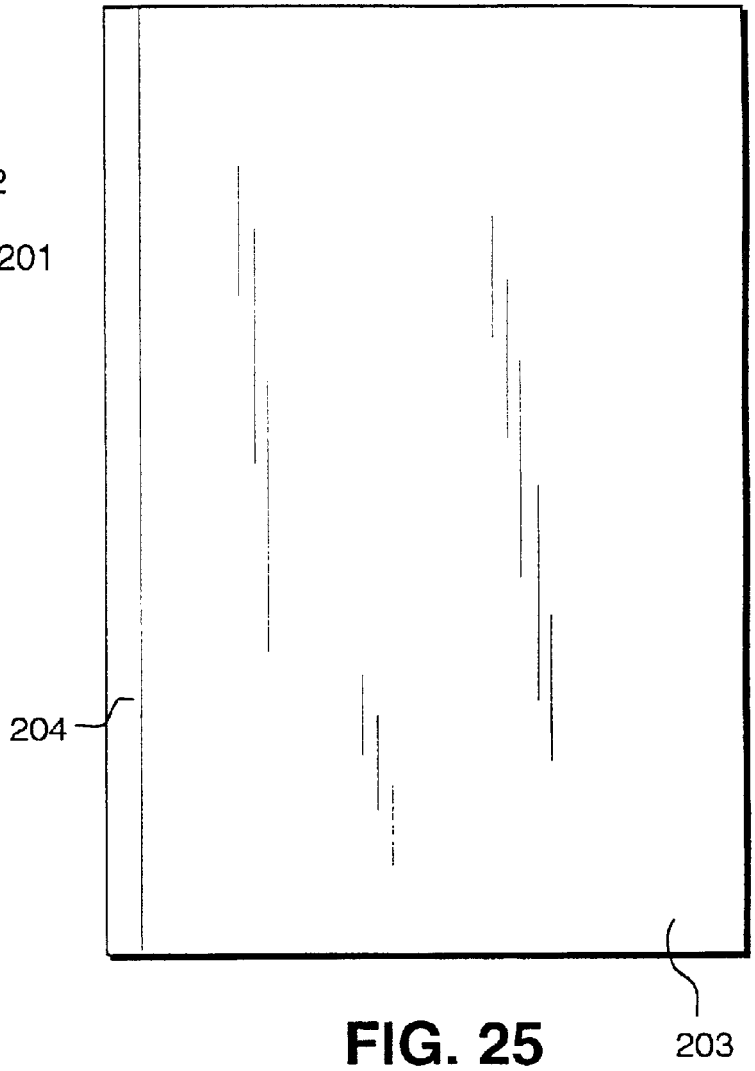
FIG. 25 shows a sheet having the band according to the invention.

Whichever is its structure, band 201 according to the invention, preferably comprised of protection silicone material releasable by the various glues employed, provides a glue zone 202 to be placed on the sheet 203 (see FIGS. 22 and 23 and 24) for coupling with the same in the application zone 204 (see FIG. 25).

On the continuous band 201, at the end of the glue zone 202, a zone 205 without glue is provided, for the subsequent removal of the silicone material band, followed by a zone 206 serving to reveal, by apparatus or visually, the end of a band section and the beginning of the following one to be applied on another sheet 203.

Obviously, length of each section 201 can be established in function of the dimensions of the sheets to be bound (for example A3, A4, etc. size).

Between the sections of the band 201 a cut 207 is provided for the manual or machine assisted separation.

On the opposite side of the band 201 according to the invention a layer (not shown) of cold activated glue is provided, dimensionally corresponding to the zone 202, which will be useful for the binding of the single sheet 203 with other sheets.

Figure 26:
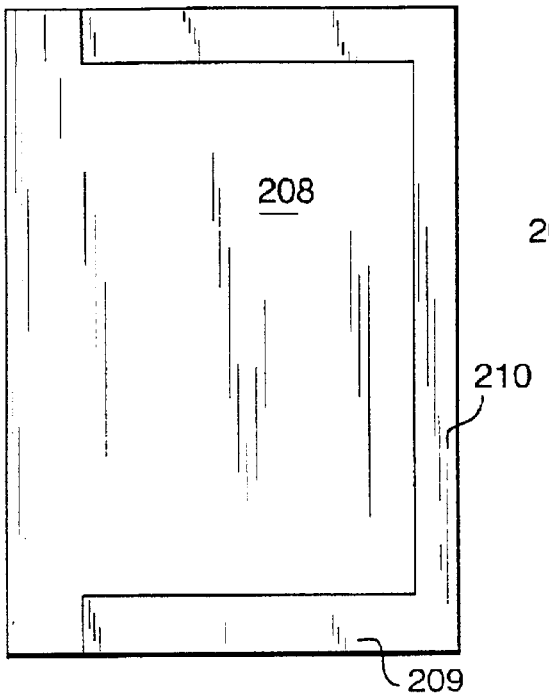
FIG. 26 shows a plurality of sheets prepared beforehand with the band according to the invention.
Figure 27:
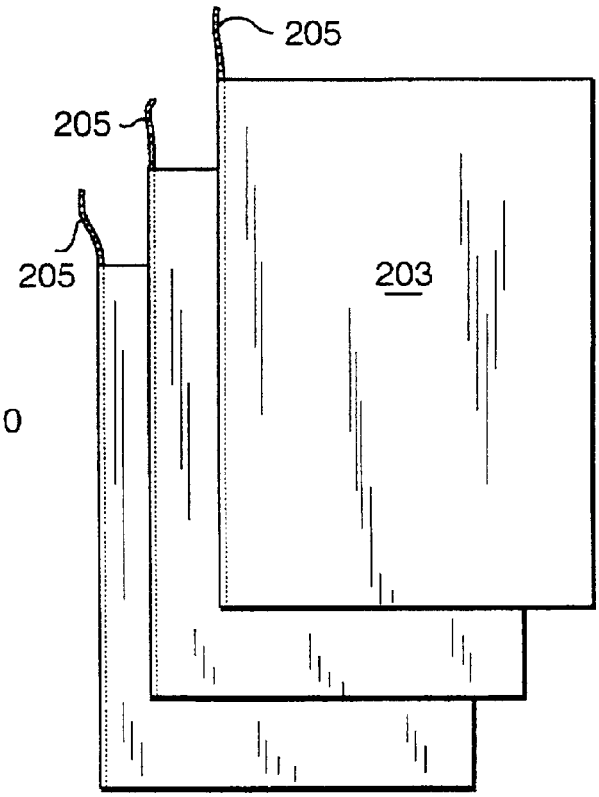
FIG. 27 shows a device for the proper positioning of sheets provided with bands according to the invention.
Figure 28:
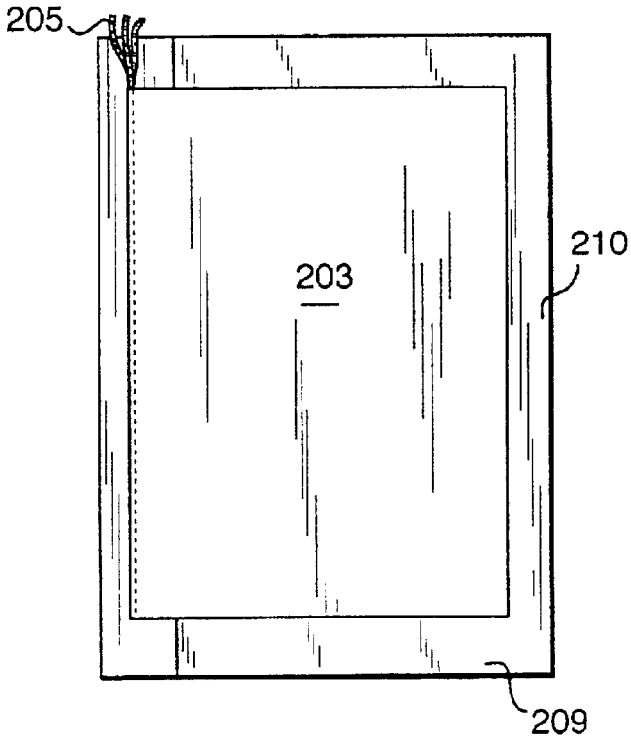
FIG. 28 shows the sheets of FIG. 26 into the device of FIG. 27 ready for binding.

In fact, as it can be noted observing FIGS. 26, 27 and 28, binding of sheets 203 prepared beforehand with the band 201 according to the invention can be carried out in a very simple and fast way.

Single sheets 203, upon which the band section 201 has been placed, with the zone 205 without glue projecting, as shown in FIG. 24, are stacked and placed within a squaring device 208, providing at least two raised sides 209 and 210, placed at 90° each other.

Sheets 203 are placed as shown in FIG. 28, eventually with an outer cover, and thus the section 205 without glue is pulled, removing the protection layer of the binding glue, comprised of the same silicon material.

Band 201 according to the invention can be obviously also provided on both sides of the sheet 203, in order to bind a sheet not prepared with the band 201.

Figure 23:
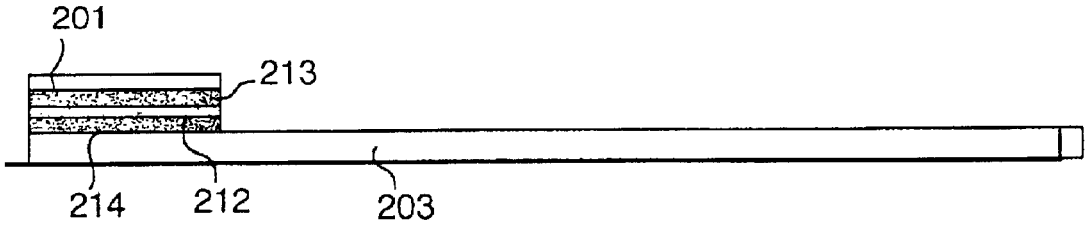
FIG. 23 is a section view of a second embodiment of a band according to the invention.

In FIG. 23 a solution is shown providing, instead of the glue sections 202, both sides adhesive tape sections 211, providing a second support 212 having the glue on the two sides 213 and 214, one of which (214) must adhere on the sheet 203 to be bound, and the second one (213) to be adhered to the sheet 203 that during the binding will be coupled with the sheet 203 having the band 201.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. A method for irreversibly binding a plurality of sheets together, comprising:

(i) superimposing a first sheet on a second sheet, said first sheet having an adhesive strip comprising an adhesive element selected from the group consisting of a glue and a two-sided tape, wherein the tape is adhesive on both surfaces, along at least one of its edges, and a silicone material band, releasably placed on said glue or adhesive tape strip and having at least a portion not coupled to said glue or adhesive tape strip, such that the uncoupled portion may be used to grasp the silicone band during its removal over said second sheet;

(ii) grasping the uncoupled portion of the silicone band; and (iii) pulling the uncoupled portion of the silicone band while said first and second sheets are superimposed so as to uncover the glue or adhesive tape strip and thereby irreversibly bind the two sheets together.

2. A method for irreversibly binding sheets together, comprising:

(i) superimposing a plurality of sheets, each having an adhesive strip along at least one of its edges and a silicone material band, releasably placed on said adhesive strip and having a portion uncoupled to the adhesive strip and extending beyond the sheet, such that the adhesive strips of successive sheets are superimposed;

(ii) grasping the uncoupled portion of the silicone bands extending beyond the successive sheets; and (iii) pulling the uncoupled portions of the silicone bands extending beyond said sheets while said plurality of sheets are superimposed so as to remove the silicone bands and uncover the adhesive strips, thereby irreversibly binding successive sheets together.

3. The method of claim 2, further comprising binding the plurality of sheets to at least one sheet that does not have an adhesive strip.

4. The method of claim 2, wherein the sheets to be bound include a binding cover.

* * * * *